US007124729B2

(12) United States Patent
Caracciolo

(10) Patent No.: US 7,124,729 B2
(45) Date of Patent: Oct. 24, 2006

(54) ADDITIVE-CONTAINING, DISSOLVABLE COATING ON ENGINE PART THAT CONTACTS OIL

(75) Inventor: Frank Caracciolo, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 38 days.

(21) Appl. No.: 10/771,207

(22) Filed: Feb. 2, 2004

(65) Prior Publication Data

US 2004/0159304 A1 Aug. 19, 2004

Related U.S. Application Data

(60) Provisional application No. 60/447,390, filed on Feb. 14, 2003.

(51) Int. Cl.
*F01M 1/00* (2006.01)

(52) U.S. Cl. ..... 123/196 R; 123/195 C

(58) Field of Classification Search ..... 123/1 A, 123/196 R, 196 CP, 195 C, 190.16, 90.33, 123/73 AD, 41.33; 184/1.5, 6.5
See application file for complete search history.

(56) References Cited

U.S. PATENT DOCUMENTS 3,336,223 A * 8/1967 Kneeland ..... 508/287
4,066,559 A 1/1978 Rohde
4,075,097 A 2/1978 Paul
4,075,098 A 2/1978 Paul et al.
4,270,497 A * 6/1981 Valerio ..... 123/195 C
4,834,894 A * 5/1989 Scheld ..... 508/183
5,552,040 A 9/1996 Baehler et al.
5,591,330 A * 1/1997 Lefebvre ..... 210/203
5,718,258 A 2/1998 Lefebvre et al.
6,045,692 A * 4/2000 Bilski et al. ..... 210/198.1
2004/0014614 A1 1/2004 Burrington et al.

FOREIGN PATENT DOCUMENTS

JP 02004285828 A * 10/2004
WO WO2004/007653 A2 1/2004

* cited by examiner

*Primary Examiner*—Tony M. Argenbright
*Assistant Examiner*—Katrina B. Harris
(74) *Attorney, Agent, or Firm*—Kathryn A. Marra

(57) ABSTRACT

An engine part that contacts oil during engine operation has a coating layer that provides one or more oil additives into the oil during a desired period of engine use. The coating layer includes one or more oil additives that are incorporated into the oil over the period of engine use as well as a coating matrix that releases the additive(s), e.g. by dissolution or diffusion of the additive(s), into the oil over the desired period of engine use. The additives replenish the oil to maintain or improve oil performance over the period of engine use.

22 Claims, 2 Drawing Sheets

(section 2-2)

(section 2-2)

(section 2-2)

(section 2-2)

ADDITIVE-CONTAINING, DISSOLVABLE COATING ON ENGINE PART THAT CONTACTS OIL

CROSS-REFERENCE TO RELATED APPLICATIONS

This application claims the benefit of U.S. Provisional Application No. 60/447,390, filed on Feb. 14, 2003.

FIELD OF THE INVENTION

The present invention relates to articles and methods for extending the service life of engine oil and engine lubrication systems. In particular, the present invention concerns a coating that slowly dissolves to release beneficial additives into the engine oil and to a method of extending the service life of engine oil with such a coating.

BACKGROUND OF THE INVENTION

Oils for lubricating engines, such as internal combustion engines, are formulated with a combination of additives for improving and prolonging oil performance. The additives counter oil degradation that occurs during use. For example, thermoplastic polymers with antioxidant additives have been incorporated into engine oil to extend the useful life of the oil, as described in U.S. Pat. Nos. 4,066,559 and 4,144,166, the disclosures of which are each incorporated herein by reference. Over time, however, the additives are depleted during use of the oil. Oil degradation and sludge formation occurs due to the oxidative deterioration of engine oil at high temperatures and reaction between the engine oil and fuel, water, blow-by gas (constituents comprising $O_2$, $N_2$, $NO_x$, $SO_x$), or by other means. The trend in recent years has been toward the higher output of a gasoline engine and smaller capacity of an oil pan for the engine oil to save energy, reducing the amount of oil and, at the same time, the amount of additives in the oil.

One proposed solution to depletion of oil additives has been to provide a source for replenishing the additives. U.S. Pat. Nos. 5,591,330 (Lefebvre), 5,552,040 (Baehler et al.), 4,075,097 (Paul), and 4,075,098 (Paul et al.) describe oil filters modified to release additives into the engine oil over time. U.S. Pat. No. 5,718,258 to Lefebvre et al. describes a separate canister for releasing oil additives into oil that is mounted between the oil filter and the engine block. The methods described in these patents, however, can provide only limited amounts of oil additives. Further, the methods do not contemplate non-linear rates of additive release. Non-linear rates of additive release would be desirable, for example, to adjust additive release to engine performance or to a desired replenishment plan for a particular vehicle. For these reasons, there remains a need for efficient and effective replenishment of oil additives into engine oil.

SUMMARY OF THE INVENTION

An engine part that contacts oil during engine operation has a coating layer that provides one or more oil additives into the oil during a desired period of engine use. As used herein, "engine part" refers to a permanent engine part, by which is meant a part that is not intended to be replaced at intervals during the useful life of the engine. Thus, oil filters and such temporary auxiliaries are excluded. The coating layer includes one or more oil additives that are incorporated into the oil over the period of engine use as well as a coating matrix that releases the additive(s), e.g. by dissolution or diffusion of the additive(s), into the oil over the desired period of engine use. The additives replenish the oil to maintain or improve oil performance over the period of engine use. The coating may include a thermoplastic polymer that dissolves over the desired period of engine use to provide improved performance itself to the oil. The coating layer has a concentration of the additive(s) and covers a sufficient area of the engine part or parts to provide a desired amount of additive(s) to the oil over a desired period of engine use.

The coating layer extends the useful life of the engine oil and reduces engine maintenance by extended release of performance additives into the oil. The coating is designed to provide a desired release rate of additives during engine use, and may release additives into the oil at a linear or nonlinear rate. For example, the coating may have a homogenous concentration of the additive or additives and/or may include a gradient concentration of one or more additives to release an increasing or decreasing amount of additive over time, or any combination of these. A coating that dissolves to release the additive(s) may include a layer or layers of coating matrix without additive to provide a period of time during which no additive is released or with a different concentration of additive to provide a period of time during with additive is released into the oil at a different rate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

"About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art through this ordinary meaning, then "about" as used herein indicates a possible variation of up to 5% in the value.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

An engine part that contacts oil during engine operation has a coating layer that provides one or more additives into the oil over time. The coating includes one or more oil additives and a matrix that releases the additive or additives at a desired rate into the oil. The coating layer includes one or more oil additives that are incorporated into the oil.

Figure 1:
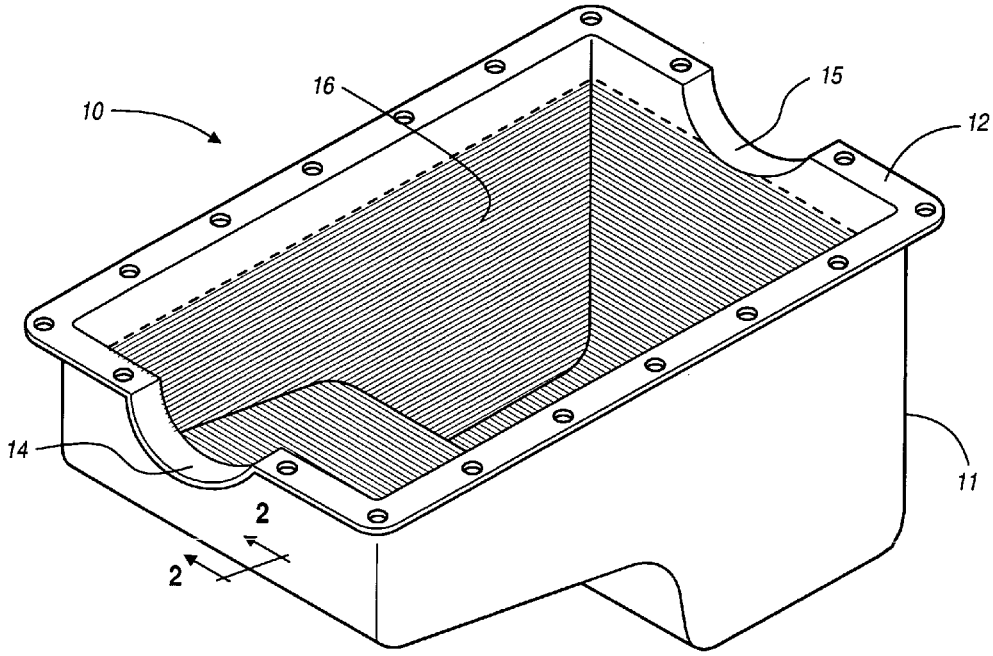
FIG. 1 is perspective view of an engine oil pan having an interior coating.

FIG. 1 is an embodiment of the invention in which the engine part is an oil pan 10. The pan 10 has an exterior 11 and a seal flange 12 which mates with a corresponding flange (not shown) on the lower surface of an engine crankcase. Semi-circular seal openings 14 and 15 at each end of the pan 10 provide clearance for the rotation of the crankshaft. Engine oil does not typically fill the entire oil pan 10, but a desired amount of engine oil is contained in the oil pan 10 to prevent engine damage. The interior of the pan is coated with coating layer 16. FIG. 1 illustrates the coating over substantially all of the interior surface of oil pan 10, but the coating may cover only a lower part of the pan, such as the bottom or the bottom plus an area of the sides that will generally be substantially under the oil level.

In addition to or instead of the interior of the oil pan 10, an article having thereon a coating layer that provides one or more additives into the oil over time, such as a panel, could be fixedly attached within the cavity of the oil pan 10. Such a panel may be straight or contoured. In another embodiment, a portion of the crankshaft in contact with the oil may have a coating layer that provides one or more additives into the oil over time.

Figure 2A:
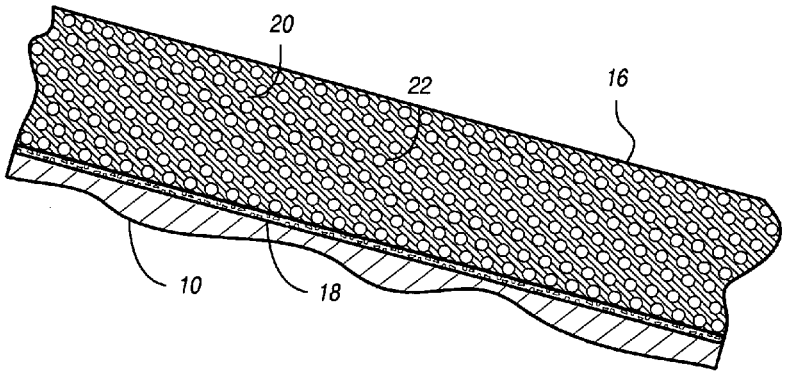
FIGS. 2A–2D are cross-sectional views taken along line 2—2 of alternate coating embodiments.

FIG. 2A shows one embodiment with cross-sectional view of coating layer 16 on engine part substrate 18. (Only an upper edge of substrate 18 is shown). Coating layer 16 comprises a continuous matrix material 20 and an additive 22 shown dispersed or blended as discrete regions in matrix material 20. Additive 22 may instead be dissolved in matrix material 20 and be released as matrix materials dissolve in the oil. In FIG. 2A, additive 22 has a generally homogenous concentration in coating 18.

Figure 2B:
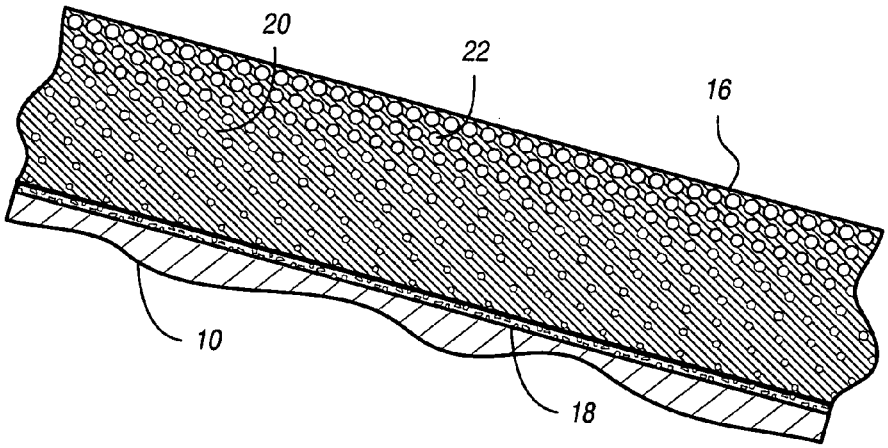

FIG. 2B shows an alternate embodiment with coating layer 16 on engine part substrate 18. Coating layer 16 again comprises a continuous matrix material 20 and an additive 22, but now the concentration of additive 22 in coating 18 increases with depth of the coating, having its lowest concentration at the surface of the coating and its highest concentration nearest the substrate. Additive 22 will be released from coating layer 16 at an increasing concentration during engine use. The concentration need not increase at a linear rate with depth. In broader terms, the additive concentration in the coating may be lower at a point at or near the surface than it is at a point further from the surface.

Figure 2C:
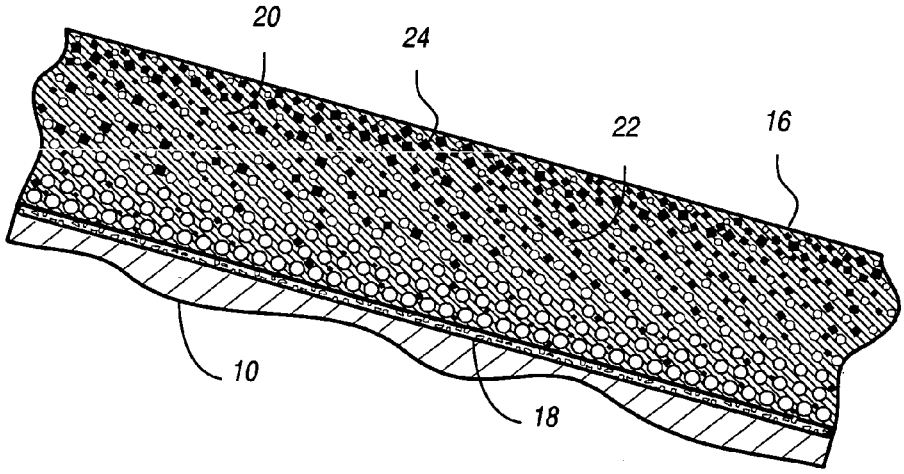
Figure 2D:
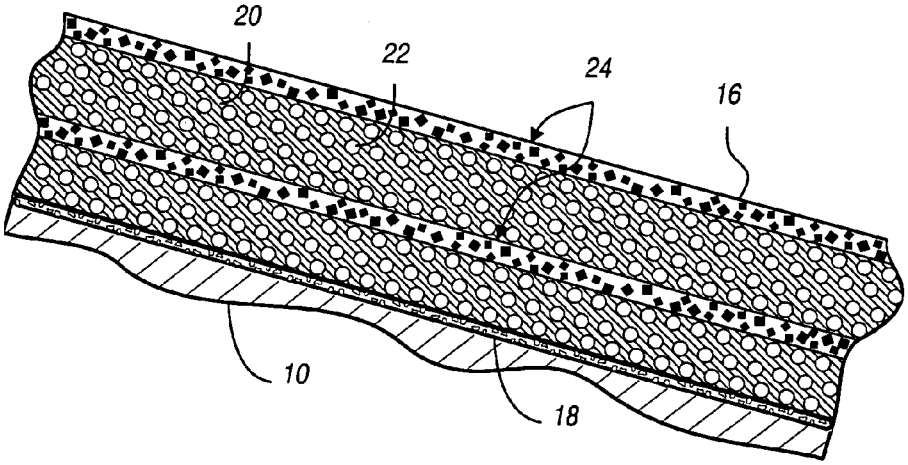

FIG. 2C shows an alternate embodiment of coating layer 16 on engine part substrate 18, with coating layer 16 comprising a continuous matrix material 20, an additive 22, and an additive 24. The concentration of additive 22 in coating 18 increases with depth of the coating, while the concentration of additive 24 decreases with depth of the coating. During engine use, additive 22 will be released from coating layer 16 at an increasing concentration while additive 24 will be released from coating layer 16 at a decreasing concentration. Again, the decrease of concentration need not be linear with depth; more broadly, the additive concentration in the coating is higher at a point at or near the surface than it is at a point further from the surface FIG. 2D shows an alternate embodiment with coating layer 16 on engine part substrate 18. Coating layer 16 again comprises a continuous matrix material 20 and an additive 22, but now further includes sublayers 24 different from the sublayers including matrix material 20 and additive 22. Sublayers 24 may be used to tailor additive release into the oil during engine use. For example, a sublayer 24 may contain no additive, may contain an additive different from the additive 22, or may contain additive 22 in a different concentration. A sublayer 24 may contain a matrix different from matrix material 20, for example a matrix material designed to dissolve in the oil at a rate different from the dissolution rate of matrix material 20 in the oil.

The matrix material may be soluble or insoluble in the engine oil. If the matrix material is insoluble in the oil, then it is porous to allow the additive(s) to slowly elute into the oil. Such a matrix material should have a pore structure that allows the additive(s) to elute at a desired rate over the desired period of engine use. Suitable examples of such porous, oil-insoluble matrix materials include porous ceramic materials having pore structures that are continuous to the surface and glass frit materials. A polymeric material matrix material having pore structures that are continuous to the surface would also be a suitable matrix. Additives may be deposited into the pores of such materials by impregnation of a solution of the additive or additives into the matrix, followed (if desired) by removal of the solvent; or by impregnation of a melt comprising the additives.

In a preferred embodiment, the matrix material is soluble in the oil. One suitable coating matrix material is a polymeric material that dissolves in the oil at a desired rate. The polymeric matrix material is preferably slowly dissolvable in oil. When the oil contacts the additive-containing polymer composition, the polymer has a low rate of dissolution in the oil and thereby slowly dissolves and/or dispersed in the oil. The additives that are oil soluble also dissolve in the oil as they are exposed to the oil by the dissolving matrix. Additives that are not oil soluble are carried along with the oil to perform their intended function. Useful polymeric materials include, without limitation, paraffins, cellulose derivatives, ethylene-propylene copolymers, especially those with weight average molecular weights of from about 200,000 to about 300,000, ethylene-ethyl acrylate copolymers, especially those with weight average molecular weights of from about 200,000 to about 300,000, polypropylene oxides, particularly those having weight average molecular weights of from about 400,000 to about 600,000, ethylene-vinyl acetate copolymers, especially those having weight average molecular weights of from about 200,000 to about 300,000, vinyl polymers, especially those that may function as viscosity index improvers in the oil such as acrylic copolymers (e.g., copolymers of methacrylate or acrylate esters of fatty alcohols, e.g. lauryl methacrylate and stearyl methacrylate, N-vinyl pyrrolidone) and polyisobutylenes, especially acrylic copolymers having weight average molecular weights of from about 200,000 to about 1,500,000, polyisobutylene polymers having weight average molecular weights of from about 80,000 to about 135,000, and combinations of these materials. Polystyrene and styrene copolymers (e.g., copolymers with methacrylate and/or acrylate monomers or partially hydrogenated block copolymers of styrene and 1,3-butadiene and/or isoprene) having weight average molecular weights of from about 30,000 to about 50,000 and propylene copolymers having weight average molecular weights of from about 50,000 to about 1500,000 preparing by polymerizing propylene with monoolefins with 10 to 24 carbon atoms are further suitable examples. In general, solubility of the polymeric material in engine oil will increase with temperature. The polymeric material should be selected to have a desired dissolution rate during engine use when the oil becomes heated. The dissolution rate of the polymer in the heated engine oil can be adjusted by adjusting the molecular weight of the polymer and/or by polymerizing with monomers that tend to make the polymer more or less soluble in the oil.

The preferred polymer or combination of polymers (blended or layered) will depend on the engine in which it is used because, for example, operating temperatures of engines vary. Among those that are preferred are polymers that act as viscosity index improvers, pour point depressants, or foam inhibitors when dissolved in the oil.

The coating layer of porous, insoluble matrix material may be applied to the surface of the engine part that contact engine oil by forming a sheet of such a coating layer (e.g., by extrusion) and adhering it to the surface of the engine part using an oil-insoluble, high temperature adhesive. Depending on the oil soluble matrix material, it may also be possible to apply the coating as a melt or mixture in a carrier solvent to sheet metal before forming the sheet metal into the engine part (e.g., oil pan), e.g. by roll coating or coil coating methods. The coating may also be deposited on the formed part as a hot melt or mixture in a carrier solvent, e.g. by curtain coating, dip coating, or spray coating methods.

The additives of the coating can be in liquid or solid form. The particular additives used in the coating will depend upon the desired type and amount of additive replenishment. Quality crankcase lubricants contain, for example, detergent additives, ashless dispersants, oxidation inhibitors, rust inhibitors, demulsifiers, extreme pressure agents, friction modifiers, multifunctional additives, viscosity index improvers, pour point depressants, and foam inhibitors.

Suitable examples of detergent additives include, without limitation, sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, metal sulfonates, metal phenates, metal phosphenates, metal salts of an alkyl salicylic acid, carboxylates, overbased detergents and chemical and physical mixtures thereof, and so on.

Suitable ashless dispersants include, without limitation, alkenyl succinimides, alkenyl succinimides modified with other organic compounds, alkenyl succinimides modified with boric acid, and alkenyl succinic ester.

Suitable oxidation inhibitors include, without limitation, phenolic antioxidants, such as: 4,4'-methylenebis (2,6-di-tert-butylphenol), 4,4'-bis(2,6-di-tert-butylphenol), 4,4'-bis (2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-4-(N,N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl4-hydroxybenzyl); metal dithiophosphates and metal dithiocarbamates (e.g., zinc dithiocarbamate and methylenebis (dibutyidithiocarbamate)); and diphenylamine type oxidation inhibitors such as alkylated diphenylamine, phenyl-I-naphthylamine, and alkylated I-naphthylamine. One particularly preferred antioxidant 4,4'-methylenebis(2,6-di-tert-butylphenol).

Suitable rust inhibitors include, without limitation, nonionic polyoxyethylene oxide surfactants, such as polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; as well as other compounds, such as stearic acid and other fatty acids, dicarboxylic acids, metal soaps, fatty acid amine salts, metal salts of heavy sulfonic acid, partial carboxylic acid ester of polyhydric alcohol, and phosphoric ester.

Suitable demulsifiers include, without limitation addition products of alkylphenol and ethylene oxide, polyoxyethylene alkyl ether, and polyoxyethylene sorbitan ester.

Suitable examples of extreme pressure agents include, without limitation, zinc dithiophosphates, zinc dithiocarbamates, zinc dialkyldithiophosphate (primary alkyl type & secondary alkyl type), zinc diaryl dithiophosphate, sulfurized oils, diphenyl sulfide, methyl trichlorostearate, chlorinated naphthalene, fluoroalkylpolysiloxane, and lead naphthenate.

Suitable examples of friction modifiers include, without limitation, fatty alcohol, fatty acid, amine, borated ester, and other esters.

Suitable examples of multifunctional additives include, without limitation, sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound.

Suitable examples of viscosity index improvers, include, without limitation, polymethacrylate type polymers, ethylene-propylene copolymers, styrene-isoprene copolymers, hydrated styrene-isoprene copolymers, polyisobutylene, and dispersant type viscosity index improvers.

Poly(methyl methacrylate) is an example of a pour point depressant.

Suitable examples of foam inhibitors include, without limitation, alkyl methacrylate polymers and dimethyl silicone polymers.

The coating containing the one or more additives is applied to one or more engine surfaces that contact the engine oil during operation of the engine. Examples of such engine surfaces include, without limitation, the interior surfaces of an engine oil pan, crankshaft, and one or more insert panels positioned in the engine oil pan to be at least partly submerged in the oil.

The coating with a polymeric matrix material may be applied by any suitable means. For example, the coating may be prepared by melt mixing in an extruder, pulverizing the extrudate, and application of the solid particulate coating material, e.g. by powder coating methods like electrostatic spraying or by use of a fluidized bed, followed by fusion of the coating at a suitable elevated temperature at which the polymeric binder melts and fuses. It is also possible to apply the coating as a melt or as a dispersion or solution in an appropriate liquid medium, e.g. water or an organic solvent, for example by spray coating, dip coating, roll coating, curtain coating, and the like. The coating may alternatively be applied to one surface of sheet metal, e.g. by a coil coating process, with the sheet metal being formed into the engine part after coating. Application of a coating with an additive gradient could be accomplished, for example, by layering compositions that have differing concentrations of additives, including layers that have no additives or that do not have certain additives, or by including in one or more layers less soluble matrix materials, for example cured or lightly crosslinked materials.

The thickness of the coating layer will depend upon factors apparent to those in the field, such as the desired period for release during engine use, the types and concentration of additives in the coating layer, the type of coating matrix material, and so on. For example, a large engine oil sump pan, having an interior surface area of approximately 960 square inches, can be coated with a layer one-tenth inch thick (100 mils) of a coating composition containing about 50% by volume of oil additives would provide about 0.8 liter of additives. In an engine using 4 liters of oil, this coating thickness may potentially release over time a volume of additives representing 20% of the total original oil volume. In a small sump, typical for a 4-cylinder spark-ignition engine, the coating thickness representing the same percentage of the original oil volume can increase to about one-fourth to one-half inch (250–500 mils), depending on the coating area. The matrix material (or a component of the matrix material) need not be inert, but may itself perform beneficially as an active constituent in the oil. In such a case, additives amounting to fully 40% of the original oil volume may be available to be released to the oil over time from a coated oil pan, for example. The concentration of the additive in the coating matrix, the thickness of the coating layer, and the area of the engine part surface coated should be adjusted to provide the desired rate of additive release and the desired total amount of additive release.

The coatings contact engine oil. Typical engine oil compositions employ basestock or base oil that may be either natural, synthetic or a mixture of natural and synthetic base oils. Examples of base oils include any of the conventionally used lubricating oils, including mineral oils, synthetic oils, and mixtures of mineral and synthetic oils. Mineral basestocks can be any conventionally refined basestocks, for instance solvent refined, hydrotreated, or isomerized, e.g., wax-isomerized, basestocks. Synthetic basestocks that may be used include polyolefin, polybutene, alkylbenzene, esters, silicone oils, etc. Synthetic oils include poly(alpha-olefins) (PAO), manufactured by the oligomerization of linear alpha-olefins followed by hydrogenation and fractionation to obtain the desired product slate. 1-Decene is the most commonly used alpha-olefin in the manufacture of PAO, but 1-dodecene and 1-tetradecene can also be used. The engine oil typically includes one or all of the additives mentioned in connection with the coating.

In one embodiment, an engine lubricating oil composition would contain:

(a) a major part of a base oil of lubricating viscosity, wherein the base oil comprises 1-dodecene and/or 1-tetradecene-derived polyalphaolefins;

(b) 0% to 20% of at least one ashless dispersant;

(c) 0% to 30% of the detergent;

(d) 0% to 5% of at least one zinc dithiophosphate;

(e) 0% to 10% of at least one oxidation inhibitor;

(f) 0% to 1% of at least one foam inhibitor; and (g) 0% to 20% of at least one viscosity index improver.

Engine oil must be replenished with additives because additives deteriorate over time, e.g. through oxidation, from exposure to high temperatures, oxidative by-products of combustion, water, and fuel dilution. As a result of some of these contaminants, engine oil acidity increases, leading to further deterioration of oil additives. The coating composition is suitably formulated to replenish the additives as needed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine part that contacts oil during engine operation, comprising a coating that releases one or more oil additives into the oil during a desired period of engine use, wherein the engine part comprises a permanent engine part.

2. An engine part according to claim 1, wherein the coating covers a sufficient area of the engine part that is in contact with oil during engine operation and contains a sufficient amount of the one or more oil additives to provide a desired amount of the one or more additives to the oil over a desired period of engine use.

3. An engine part according to claim 1, wherein the coating has a substantially homogenous concentration of one or more oil additives.

4. An engine part according to claim 1, wherein the coating has a gradient concentration of one or more oil additives.

5. An engine part according to claim 1, wherein the coating comprises a layer of a coating matrix without additive.

6. An engine part according to claim 1, wherein the coating comprises a first layer comprising an additive at a first concentration and a second layer comprising the additive at a second concentration.

7. An engine part according to claim 1, wherein the engine part is one or more members selected from the group consisting of the engine oil pan, a crankshaft, and articles fixedly attached thereto.

8. An engine oil pan, comprising a coating on its interior, wherein said coating comprises a continuous matrix material and an oil additive.

9. The engine oil pan according to claim 8, wherein the additive has a generally homogenous concentration in the coating.

10. The engine oil pan according to claim 8, wherein the additive concentration in the coating is lower at a point at or near the surface than it is at a point further from the surface.

11. The engine oil pan according to claim 8, wherein the additive concentration in the coating is higher at a point at or near the surface than it is at a point further from the surface.

12. The engine oil pan according to claim 8, wherein the coating comprises a first layer comprising an additive at a first concentration and a second layer comprising the additive at a second concentration.

13. The engine oil pan according to claim 12, wherein one of the first and second concentrations is zero.

14. The engine oil pan according to claim 8, wherein the matrix material is insoluble in engine oil.

15. The engine oil pan according to claim 14, wherein the matrix material is a member selected from the group consisting of porous ceramic, glass frit, and polymeric materials having pore structures that are continuous to the surface.

16. The engine oil pan according to claim 8, wherein the matrix material is soluble in engine oil.

17. The engine oil pan according to claim 16, wherein the matrix material is a member selected from the group consisting of paraffin's, cellulose derivatives, ethylene-propylene copolymers, ethylene-ethyl acrylate copolymers, polypropylene oxides, ethylene-vinyl acetate copolymers, vinyl polymers, polyisobutylenes, and combinations thereof.

18. The engine oil pan according to claim 16, wherein the matrix material is a member selected from the group consisting of ethylene-propylene copolymers with weight average molecular weights of from about 200,000 to about 300,000, ethylene-ethyl acrylate copolymers with weight average molecular weights of about 200,000 to about 300,000, polypropylene oxides with weight average molecular weights of from about 400,000 to about 600,000, ethylene-vinyl acetate copolymers with weight average molecular weights of from about 200,000 to about 300,000, vinyl polymers that can function as viscosity index improvers in engine oil, acrylic copolymers having weight average molecular weights of from about 200,000 to about 1,500,000, polyisobutylene polymers having weight average molecular weights of from about 80,000 to about 135,000, styrene copolymers having weight average molecular weights of from about 30,000 to about 50,000 and propylene copolymers having weight average molecular weights of from about 50,000 to about 1500,000 preparing by polymerizing propylene with monoolefins with 10 to 24 carbon atoms.

19. The engine oil pan according to claim 16, wherein the matrix material is a member selected from the group consisting of polymers that act as viscosity index improvers when dissolved in engine oil, polymers that act as pour point depressants when dissolved in engine oil, and polymers that act as foam inhibitors when dissolved in engine oil.

20. The engine oil pan according to claim 8, wherein the coating comprises a member selected from the group consisting of detergent additives, ashless dispersants, oxidation inhibitors, rust inhibitors, demulsifiers, extreme pressure agents, friction modifiers, multifunctional additives, viscosity index improvers, pour point depressants, foam inhibitors, and combinations thereof.

21. A method of introducing an oil additive into engine oil, comprising a step of incorporating into an engine a permanent engine part that contacts oil during engine operation, wherein said engine part comprises a coating that release one or more oil additives into the oil during a desired period of engine use.

22. A method of introducing an oil additive into engine oil, comprising a step of applying a coating comprising at least one oil additive to an area of an engine oil pan that contacts oil during engine operation, wherein said coating is designed to release the at least one oil additive into the oil at a desired rate.

* * * * *